US008397331B2

(12) United States Patent
Pichon et al.

(10) Patent No.: US 8,397,331 B2
(45) Date of Patent: Mar. 19, 2013

(54) CLEANER APPARATUS FOR A SUBMERGED SURFACE WITH A PROTUBERANCE WHICH ACCELERATES THE INLET FLOW

(75) Inventors: Philippe Pichon, Villeneuve de Riviere (FR); Emmanuel Mastio, Fourquevaux (FR); Robert Rey, Nozay (FR)

(73) Assignee: Zodiac Pool Care Europe, Paris (FR)

( * ) Notice: Subject to any disclaimer, the term of this patent is extended or adjusted under 35 U.S.C. 154(b) by 205 days.

(21) Appl. No.: 12/863,989

(22) PCT Filed: Mar. 25, 2009

(86) PCT No.: PCT/FR2009/050511
§ 371 (c)(1),
(2), (4) Date: Nov. 9, 2010

(87) PCT Pub. No.: WO2009/125130
PCT Pub. Date: Oct. 15, 2009

(65) Prior Publication Data

US 2011/0047727 A1 Mar. 3, 2011

(30) Foreign Application Priority Data

Mar. 27, 2008 (FR) ..... 08 01675

(51) Int. Cl.
*E04H 4/16* (2006.01)

(52) U.S. Cl. ..... 15/1.7

(58) Field of Classification Search ..... 15/1.7; 210/167.1, 167.16, 167.17, 416.2, 459
See application file for complete search history.

(56) References Cited

U.S. PATENT DOCUMENTS

| | | | | |
|---|---|---|---|---|
| 4,656,683 | A * | 4/1987 | Raubenheimer | 15/1.7 |
| 5,105,496 | A * | 4/1992 | Gray et al. | 15/1.7 |
| 5,245,723 | A * | 9/1993 | Sommer | 15/1.7 |
| 5,985,156 | A | 11/1999 | Henkin et al. | |
| 7,162,763 | B2 * | 1/2007 | Henkin et al. | 15/1.7 |
| 2007/0294846 | A1 * | 12/2007 | Lapping | 15/1.7 |

FOREIGN PATENT DOCUMENTS

| | | |
|---|---|---|
| EP | 0169589 | 1/1986 |
| EP | 0622506 | 11/1994 |

OTHER PUBLICATIONS

International Search Report in Application No. PCT/FR2009/050511, Publication Date: 2009.

* cited by examiner

*Primary Examiner* — Monica Carter
*Assistant Examiner* — Andrew A Horton
(74) *Attorney, Agent, or Firm* — Dean W. Russell; Kilpatrick Townsend & Stockton LLP

(57) ABSTRACT

Detailed is a cleaner apparatus for a submerged surface including a body and at least one liquid inlet at the base of the body, characterized in that it includes at least one accelerating protuberance extending toward the submerged surface while maintaining a height of liquid, and extending, with respect of a forward travel direction of the apparatus, in front of an adjacent liquid inlet while maintaining the passage cross section of the liquid inlet.

6 Claims, 9 Drawing Sheets

Figure 1:
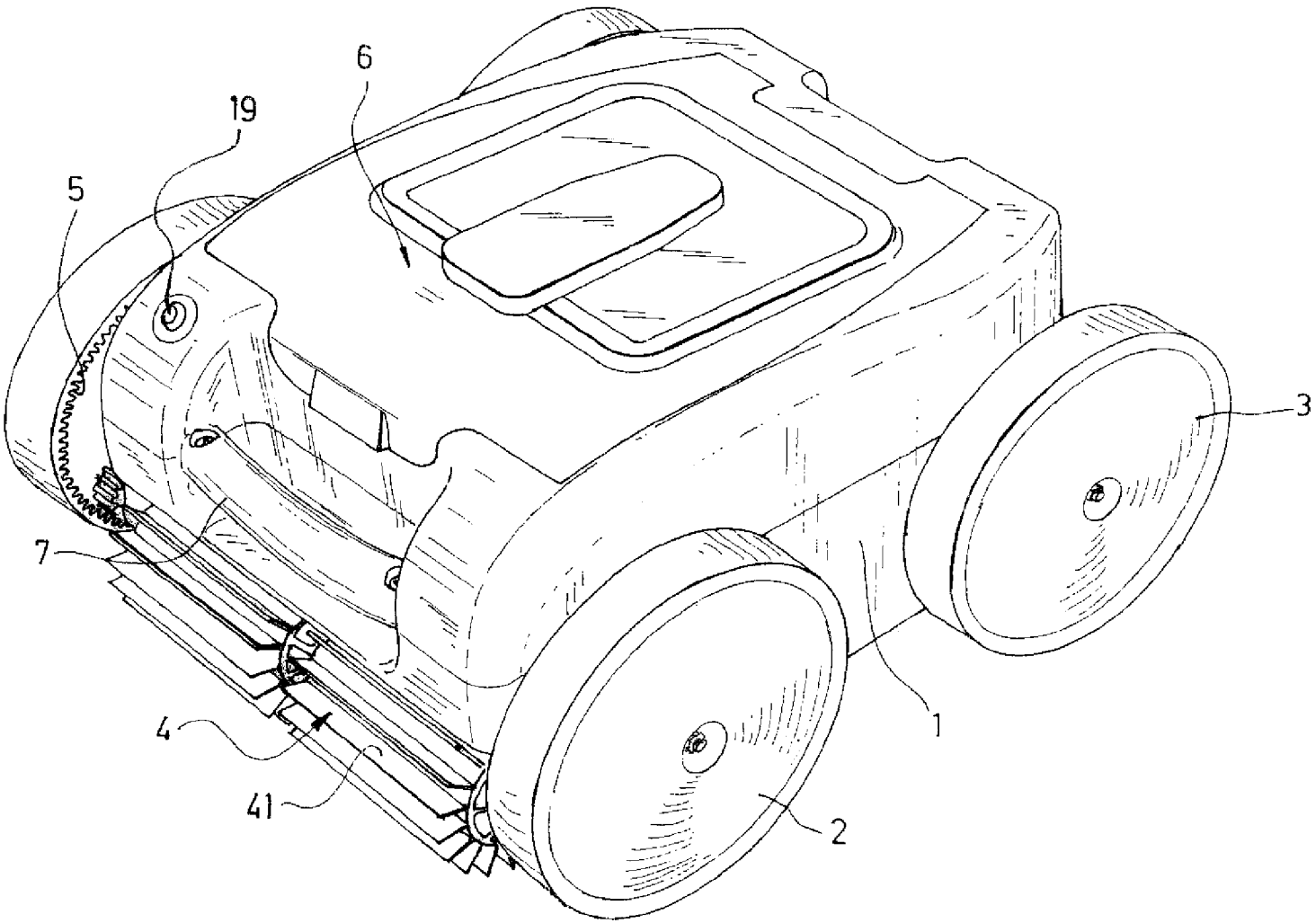

CLEANER APPARATUS FOR A SUBMERGED SURFACE WITH A PROTUBERANCE WHICH ACCELERATES THE INLET FLOW

CROSS REFERENCE TO RELATED APPLICATIONS

This application is the U.S. national phase of International Application No. PCT/FR2009/050511 filed on Mar. 25, 2009 and published on Oct. 15, 2009 as International Publication No. WO 2009/125130 A2, which application claims priority to French Patent Application No. 0801675 filed on Mar. 27, 2008, the entire contents of both of which are incorporated herein by reference.

The invention relates to a device for cleaning a surface immersed in a liquid, in particular a swimming pool.

There are already known a large number of devices for cleaning an immersed surface. In most cases, such a device for cleaning an immersed surface comprises a hollow body and members for guiding over the immersed surface, with said hollow body having a base which extends above and remotely from said immersed surface, at least one liquid inlet being arranged at the base of said hollow body so as to be able to receive a flow of liquid which conveys debris to be removed from the liquid and the immersed surface. A liquid pumping device is provided (integrated in the hollow body of the device or conversely at least partially arranged outside the device and the pool containing the liquid) in order to produce an intake of liquid into each liquid inlet, and that intake is capable of carrying debris through the corresponding liquid inlet.

The known devices for cleaning an immersed surface are most usually provided with a drive device which allows them to be moved automatically over the immersed surface. That movement may be brought about by specific motorized drive members (for example, by one or more on-board electric drive motor(s)), or conversely may be of the hydraulic type, that is to say, may be brought about at least partially by the hydraulic flow (at the intake or lift) produced by the pumping device associated with the device, or may be of the mixed type. Whatever the case may be, the problem involves the efficiency of cleaning, linked on the one hand to the capacity of the device to remove the debris from the immersed surface and, on the other hand, the quality of the intake of the debris through each liquid inlet. In this regard, it should be noted that each liquid inlet must be dimensioned so as to allow the largest debris to pass. Conversely, the greater the effective cross-section of flow of each liquid inlet, the greater is also the level of intake energy necessary for operating the device, which increases the cost of production and use thereof.

In this context, an object of the invention is to provide a device for cleaning an immersed surface whose cleaning efficiency is substantially improved and, with all things being equal, in particular without the pumping device or, where applicable, the drive device(s) associated with that device being modified.

More specifically, an object of the invention is to provide a device for cleaning an immersed surface whose cleaning efficiency is substantially improved with a negligible effect on production costs.

To that end, the invention relates to a device for cleaning an immersed surface comprising:

- a hollow body and members for guiding over the immersed surface with said hollow body having a base extending above and remotely from said immersed surface,
- at least one liquid inlet into the hollow body located at the base of said hollow body,

- a liquid pumping device which is capable of producing a liquid intake into each liquid inlet which is capable of conveying debris through said liquid inlet, characterized in that it comprises at least one protuberance which is called an acceleration protuberance and extending:
- in front, in relation to a direction of advance of the device, and in the region of a liquid inlet,
- towards the immersed surface, with a depth of liquid being maintained between said acceleration protuberance and the immersed surface,
- with formation of at least one discontinuity of curvature capable of producing, under the effect of the advance of the device, a turbulent phase in a zone immediately downstream of that acceleration protuberance, with the cross-section of flow of said liquid inlet being maintained.

Advantageously, a device according to the invention is adapted so that each acceleration protuberance receives a relative flow of liquid which flows between the base of the hollow body and the immersed surface under the effect of the advance of the device. In particular, the base of the hollow body has a shape suitable for allowing passage of the relative flow resulting from the movement of the device directly in contact with each acceleration protuberance, and at least the acceleration protuberance located nearest the front of the device relative to the direction of advance. Such an acceleration protuberance is suitable for receiving the relative flow of liquid resulting from the advance of the device and the intake through the liquid inlet under the effect of the pumping device, and such an acceleration protuberance has the effect of accelerating the speed of the liquid thereby drawn into said liquid inlet from the front of the device.

Contrary to all expectations, the inventors have found that such an acceleration protuberance provided at the front in the region of a liquid inlet does not have the effect of redirecting the flow of liquid passing in the region of that acceleration protuberance whilst moving it away from the liquid inlet, but instead allows a substantial improvement, on the one hand, in the removal of debris from the immersed surface and, on the other hand, in the intake of the debris through the corresponding liquid inlet. Such an acceleration protuberance reduces the effective flow cross-section for the liquid provided between the base of the hollow body and the immersed surface, locally accelerates the liquid, in particular under the effect of the advance of the device, in relation to the hollow body (the speed of the liquid downstream of that acceleration protuberance being greater than that of the liquid upstream of the acceleration protuberance) and therefore the solid particles and allows the debris to be removed. For all that, such an acceleration protuberance generally brings about a turbulent phase in a zone located immediately downstream and behind that acceleration protuberance (which may be specifically configured to that end), immediately upstream of the liquid inlet. The occurrences of turbulence created in this manner have the effect of removing the debris from the ground.

In this manner, advantageously, in a device according to the invention, at least one acceleration protuberance is capable of generating, under the effect of the advance of the device, a turbulent phase between that acceleration protuberance and said corresponding liquid inlet, and of bringing about an acceleration of the liquid flow in the liquid inlet.

More specifically, advantageously and according to the invention, at least one acceleration protuberance has at least a convex end which forms at least one discontinuity of curvature which is capable of generating a turbulent phase in a zone immediately downstream of that end. Such an end (which is the portion of the acceleration protuberance most remote from the base, that is to say, its lower end, when the immersed surface is substantially horizontal) which has at least one discontinuity of curvature forming a turbulent phase may involve a very large number of different embodiments. In particular, that convex end has a very small radius of curvature and/or is generally of tapering shape and/or has surface irregularities.

Furthermore, the reduction in effective cross-section of hydraulic flow brought about by the protuberance brings about a reduction in local static pressure and a Venturi effect which improves the intake of debris. In this manner, for the same effective cross-section of flow of the liquid inlet, and for the same pumping device, the intake speed is considerably increased, and therefore the rate of liquid flow in the region of that liquid inlet. In this manner, the large pieces of debris do not become blocked in the liquid inlet and are displaced at high speed in order to be drawn in by the device.

Furthermore, in a device according to the invention, since the liquid depth which allows the intake is determined by the distance between the end of an acceleration protuberance furthest away from the base and the immersed surface, the other portions of the base of the hollow body may be at a distance from the immersed surface that is greater, thereby improving the mean floor clearance (considered except for each acceleration protuberance).

Furthermore, the local reduction of the floor clearance brought about by such a protuberance not only does not involve any additional risk of blockage but instead reduces that risk. That is even more applicable because, in accordance with a preferred embodiment according to the invention, such an acceleration protuberance is arranged in the region of contact zones of driving members of the device with the immersed surface (for example, in a transverse plane at a short distance to the rear of a transverse plane containing an axle of the device).

A device according to the invention may comprise one or more adjacent acceleration protuberance(s) at a same liquid inlet, and the shapes and dimensions of each acceleration protuberance may be different. Nevertheless, the inventors have found that a simple rigid rib can act as an acceleration protuberance in accordance with the invention with a very high level of efficiency. In this manner, advantageously in a device according to the invention, at least one acceleration protuberance is generally in the form of a rib extending over at least a peripheral portion in front of said liquid inlet, preferably only along a front edge of said liquid inlet.

Furthermore, advantageously and according to the invention, said rib which forms an acceleration protuberance has an extreme edge. That extreme edge of a rib forming an acceleration protuberance constitutes the portion of the rib that is furthest from the base of the hollow body and which therefore is nearest to the immersed surface.

Preferably, advantageously and according to the invention, said rib extends at least substantially parallel with at least a front peripheral edge portion—in particular only parallel with a front peripheral edge portion—of said liquid inlet. In one embodiment, advantageously and according to the invention, said rib forms at least a front peripheral edge portion of said liquid inlet. In a variant, it is possible to provide a rib forming an acceleration protuberance which extends parallel with a front peripheral edge portion of the liquid inlet, at a given distance therefrom.

Furthermore, advantageously in a device according to the invention, at least for a generally rectangular liquid inlet, at least one acceleration protuberance has a constant height. That being so, a device according to the invention may also comprise at least one acceleration protuberance having constant height in the region of the periphery of a non-rectangular liquid inlet.

However, nothing prevents the provision of at least one acceleration protuberance extending over a height which is not constant. For example, the height of the acceleration protuberance may depend on the shape of the opening of the base forming the adjacent liquid inlet. In particular, a device according to the invention may comprise at least one acceleration protuberance whose height varies in an increasing manner in accordance with the width of said adjacent liquid inlet.

In a device according to the invention, each acceleration protuberance advantageously extends:

- so as to protrude towards the immersed surface relative to a portion of said base which extends at least substantially parallel with the immersed surface in front of said liquid inlet,
- over a height relative to the base that is less than the liquid depth retained between said acceleration protuberance and the immersed surface.

In this manner, in a device according to the invention, each acceleration protuberance preferably extends so as to protrude relative to the base over a height which is less than half the distance between the base and the immersed surface. In other words, the height of the acceleration protuberance is less than the height separating the base from the immersed surface imposed by guiding members (for example, the wheels) of the device on the immersed surface.

For example, in a device according to the invention, each acceleration protuberance extends relative to the protruding base over a height greater than 5 mm and so as to maintain a liquid depth of at least 7 mm relative to the immersed surface. Other embodiments are possible, in particular in which the notion of the height of the protuberance relative to the base would have no meaning, these two elements being in continuous extension of each other in front of the inlet.

Furthermore, advantageously, in a device according to the invention, at least one acceleration protuberance is rigid (so as not to flex under the effect of the relative speed of the liquid and the advance of the device).

Advantageously, in a device according to the invention, at least one acceleration protuberance is further generally orientated in a direction which is at least substantially normal (at least locally) relative to the base, in particular at least substantially orthogonal to the immersed surface. Other orientations are possible, but without the acceleration protuberance restricting the cross-section of flow of the liquid inlet of the base of the hollow body adjacent to that acceleration protuberance. In other words, the acceleration protuberance extends so as not to impede the liquid inlet of the hollow body and not to modify the cross-section of flow thereof.

Furthermore, advantageously in a device according to the invention, at least one acceleration protuberance is connected to a portion of said base extending at least substantially parallel with the immersed surface at the side opposite said liquid inlet by a concave connection zone forming a discontinuity of curvature. In particular, advantageously and according to the invention, at least one rib forming an acceleration protuberance is connected by a concave edge to said base at the side opposite said liquid inlet. In a variant, in a device according to the invention, at least one acceleration protuberance can be connected, at the side opposite a liquid inlet, to a portion of the base which is concave and profiled with a predetermined curvature which is capable of improving the efficiency of the redirection of the liquid flow and maintaining a boundary layer in the laminar phase as far as the end portion of the acceleration protuberance, downstream of which a turbulent phase is created.

In an advantageous embodiment according to the invention, at least one rib forming an acceleration protuberance has a generally triangular regular cross-section. That embodiment has the advantage of simplicity and a low production cost, combined with great efficiency from a hydrodynamic viewpoint. Other embodiments are possible (for example, a rib in the form of a plate extending orthogonally relative to the base).

Preferably, a device according to the invention comprises, for each liquid inlet, a single acceleration protuberance extending in accordance with at least a portion of the periphery in front of that liquid inlet.

The invention applies to all types of cleaning device, whether self-propelled or not.

In a particularly advantageous application of the invention, the device comprises members for driving that hollow body in at least one direction of advance, which is called the longitudinal direction, and in at least one preferred direction of advance in accordance with that longitudinal direction, and is characterized in that it comprises at least one acceleration protuberance in front, relative to said preferred direction of advance, of each liquid inlet. More particularly, advantageously, a device according to the invention comprises at least one acceleration protuberance in front of a front liquid inlet (that is to say, provided in the front half of the base of the hollow body).

Furthermore, advantageously and according to the invention, the device comprises at least one rear guiding wall which extends behind (in relation to said preferred direction of advance) a liquid inlet, that rear guiding wall protruding relative to the base of said hollow body over a height that is greater than the height of an acceleration protuberance extending in front of said liquid inlet (and naturally over a height less than the floor clearance defined between the base of the hollow body and the rolling plane). Such a rear guiding wall preferably extends over most of the height extending between the base and the immersed surface. It allows the intake zone to be confined to the front and the region of the liquid inlet and prevents liquid from the rear of the liquid inlet from being drawn in. To an extent, it further allows improvement of the guiding of the liquid into the liquid inlet. Such a rear guiding wall may or may not be provided with members for scraping or sweeping the immersed surface, for example, tongues or flexible filaments which can rub the immersed surface.

In a variant or in combination, nothing prevents the provision of an acceleration protuberance behind a liquid inlet relative to a direction of advance, or even over the entire periphery of an adjacent liquid inlet (without thereby restricting the cross-section of flow of that liquid inlet, as indicated above). In the case of a device of the type which is often incorrectly called "bi-directional" and which is capable of being driven in both senses of the same longitudinal direction, a liquid inlet is provided with two acceleration protuberances, one in front of that inlet for each driving direction.

Furthermore, a device according to the invention is also advantageously characterized in that at least one liquid inlet is extended in said hollow body by an inlet conduit which extends inside the body, each inlet conduit having an end at the base of said body forming said liquid inlet, and an opposite end opening into a filtering device, and in that said inlet conduit has an effective hydraulic cross-section, whose surface-area varies from said liquid inlet up to a maximum value at the opposite end thereof opening into the filtering device.

In particular, the invention applies advantageously to a device which comprises:

- a filtration chamber which is provided in said body and which has:
- at least one liquid inlet,
- at least one liquid outlet out of the hollow body, located remotely from the base of said hollow body,
- an on-board pumping device,
- a hydraulic circuit capable of ensuring, when said pumping device is active, flow of liquid between at least one liquid inlet and at least one liquid outlet, called the pumping outlet, through at least one filtering device,
- rolling members which have contact zones with the immersed surface defining a rolling plane of the hollow body over the immersed surface and at least one on-board electric drive motor for at least some of the rolling members. Preferably, in this embodiment, the device comprises front rolling members (for example, a front axle which carries front wheels), a front liquid inlet and, adjacent to and in front of that front liquid inlet, an acceleration protuberance which extends a short distance towards the rear of the contact zones of the front rolling members of the device.

The invention still also applies to other types of device, for example, a device whose hollow body does not involve a filtering device, the filtering being carried out, for example, in a device which is provided outside the pool and connected to the device.

The invention also relates to a device, characterized in combination by all or some of the features set out above or below.

Figure 2:
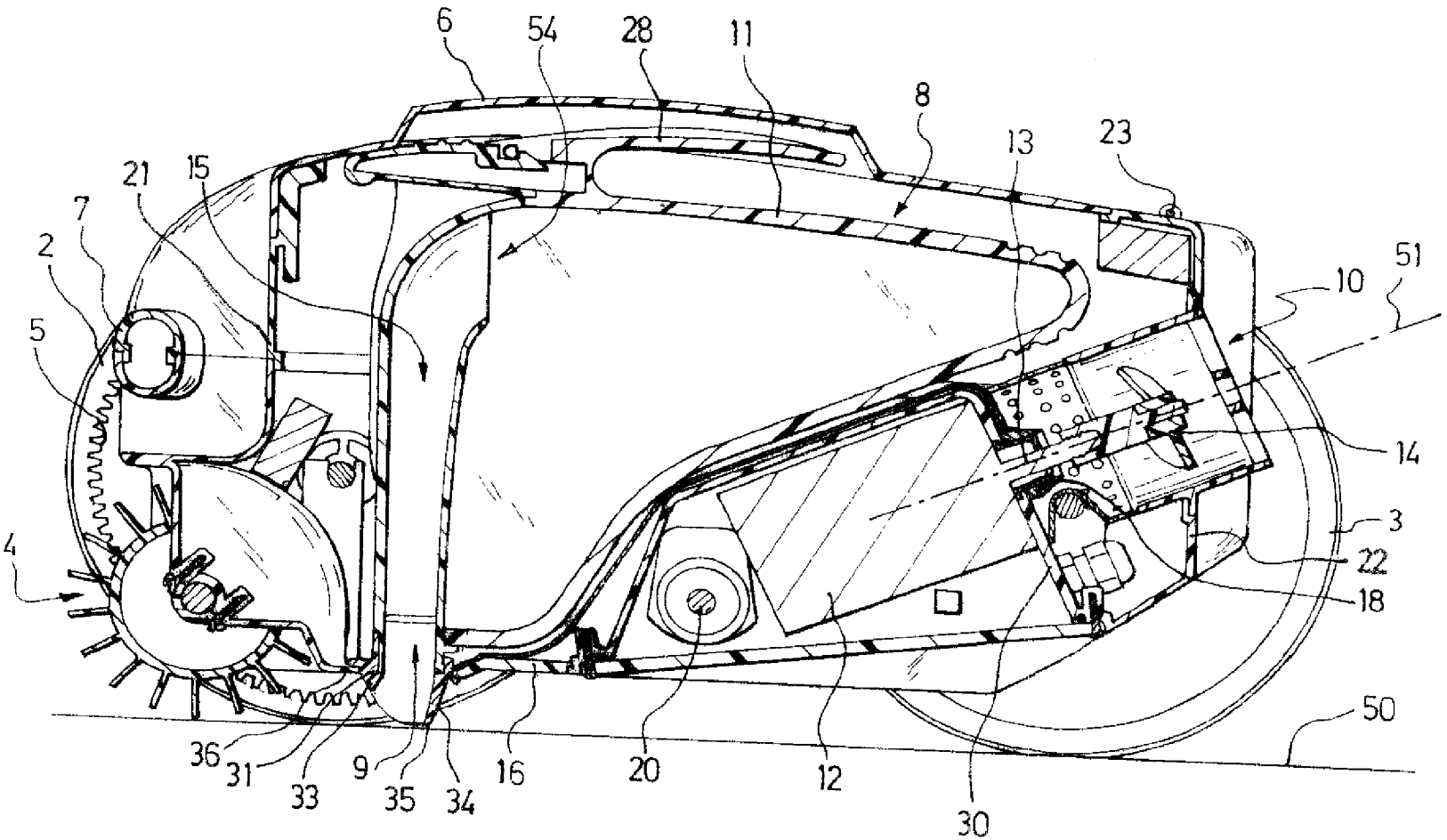
Figure 3:
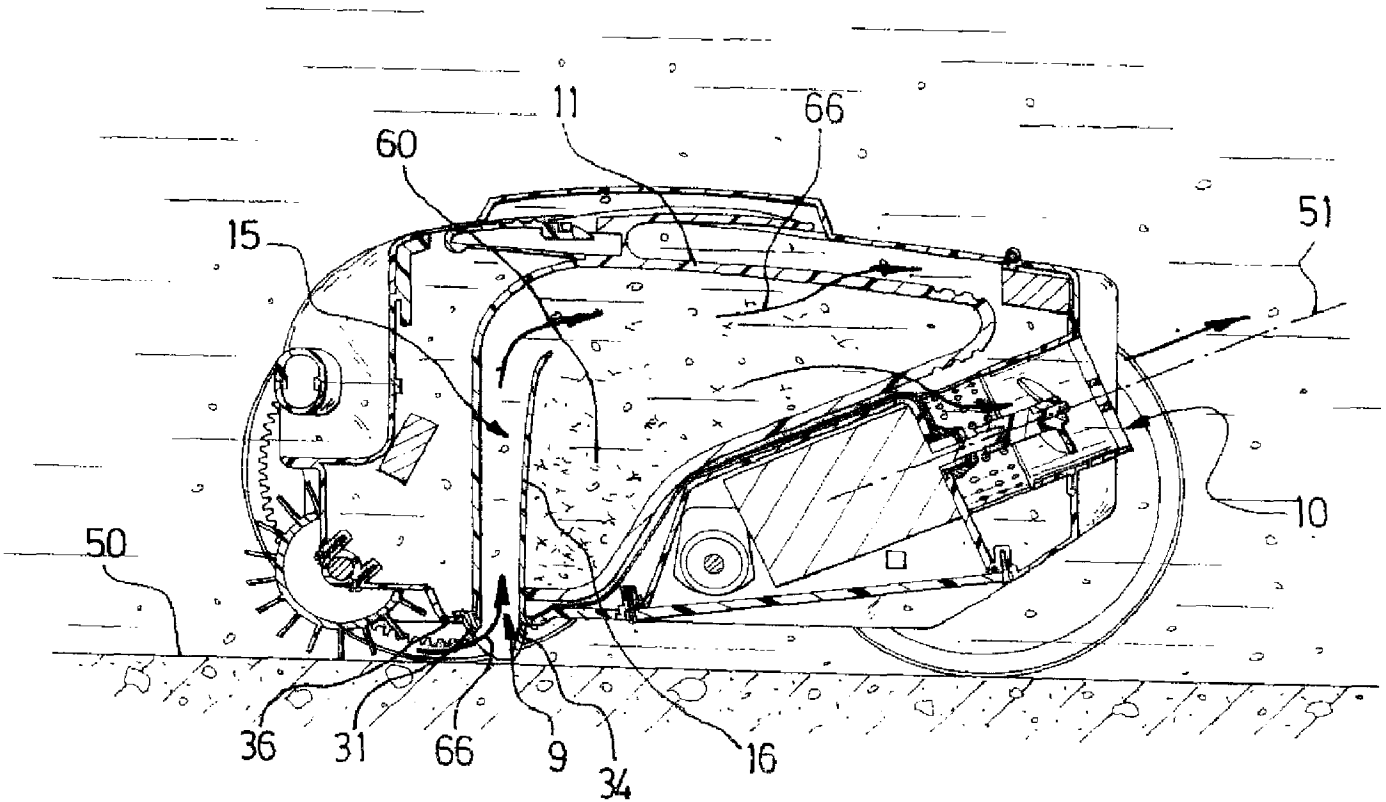
Figure 4:
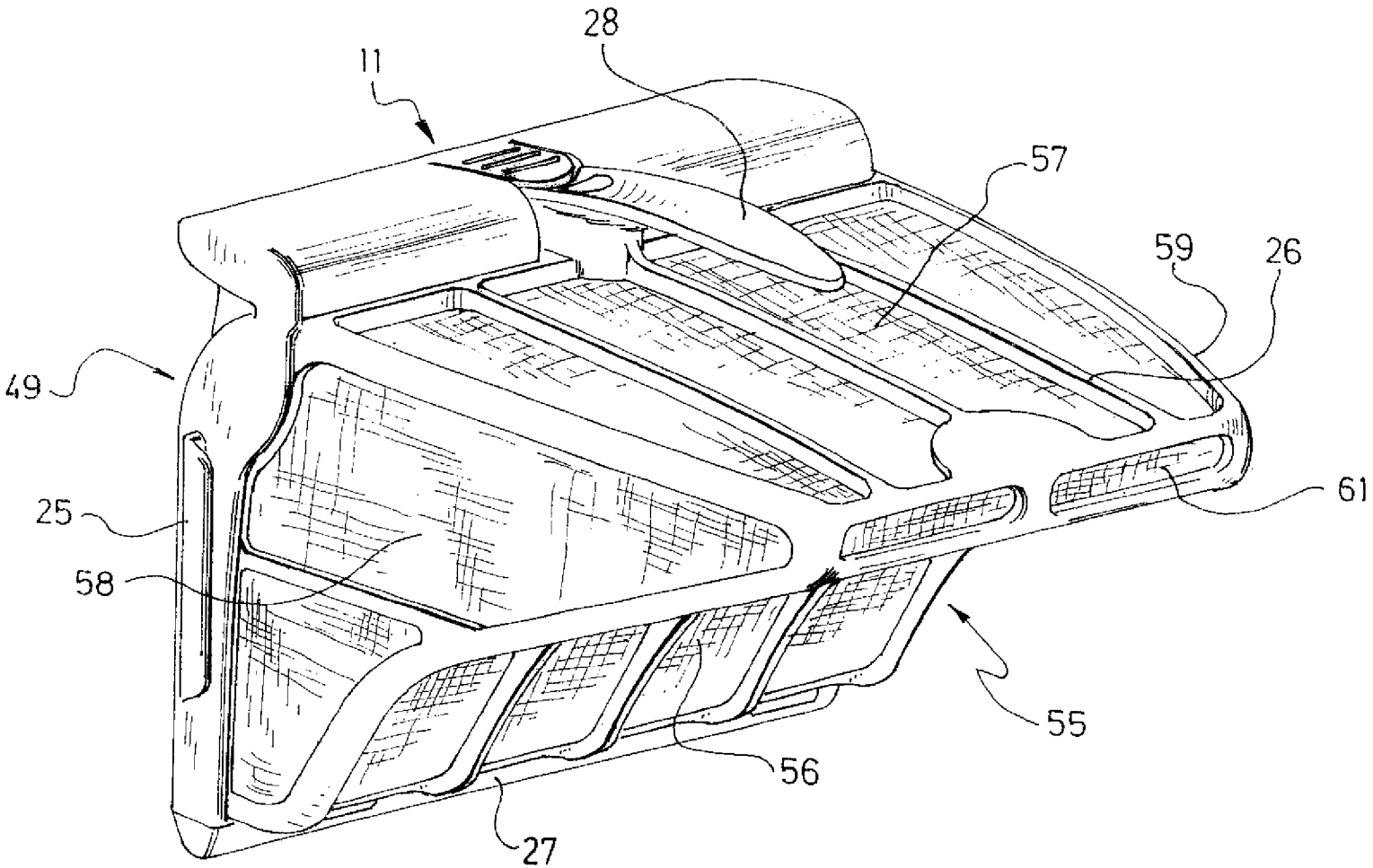
Figure 5:
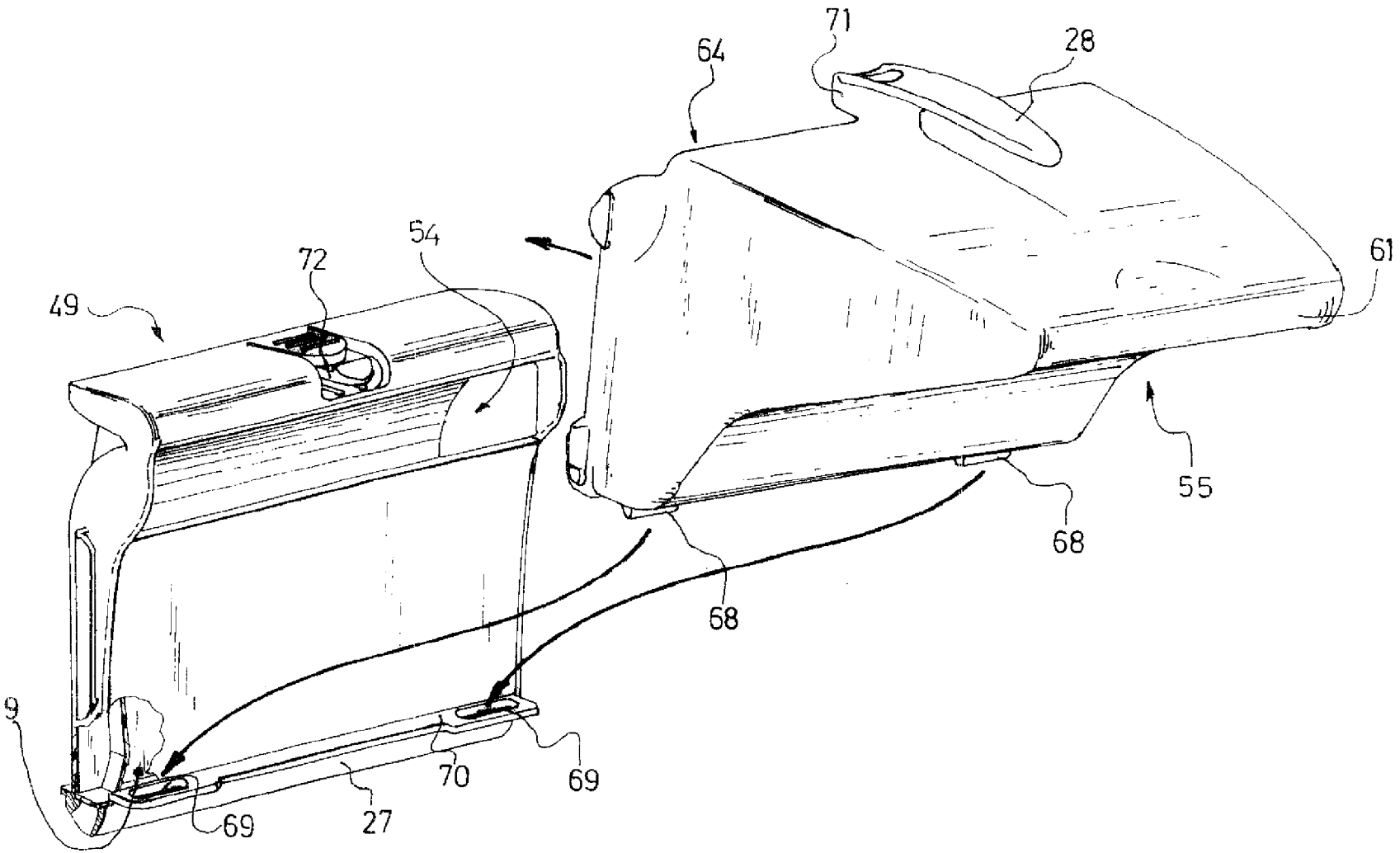
Figure 6:
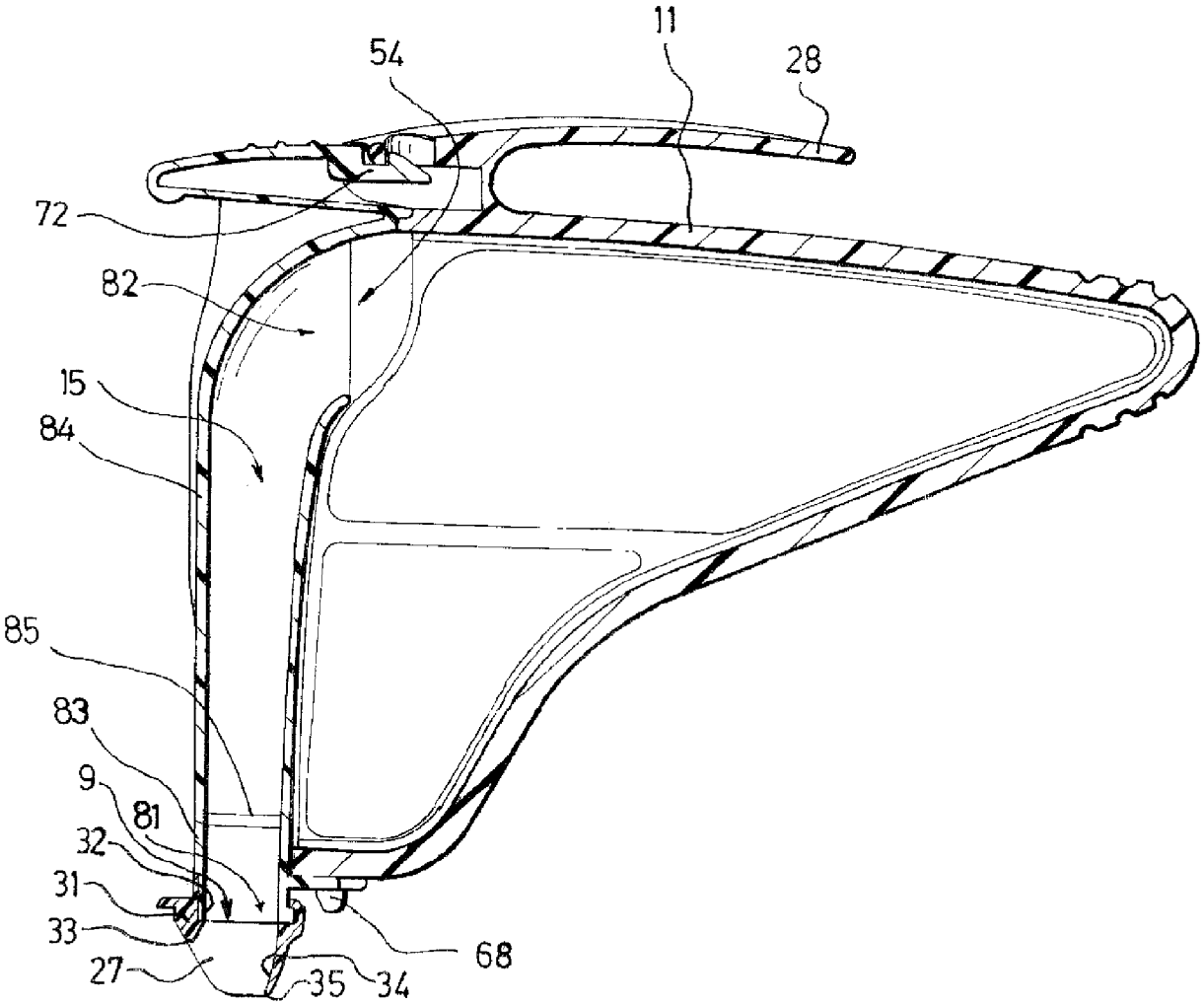
Figure 7:
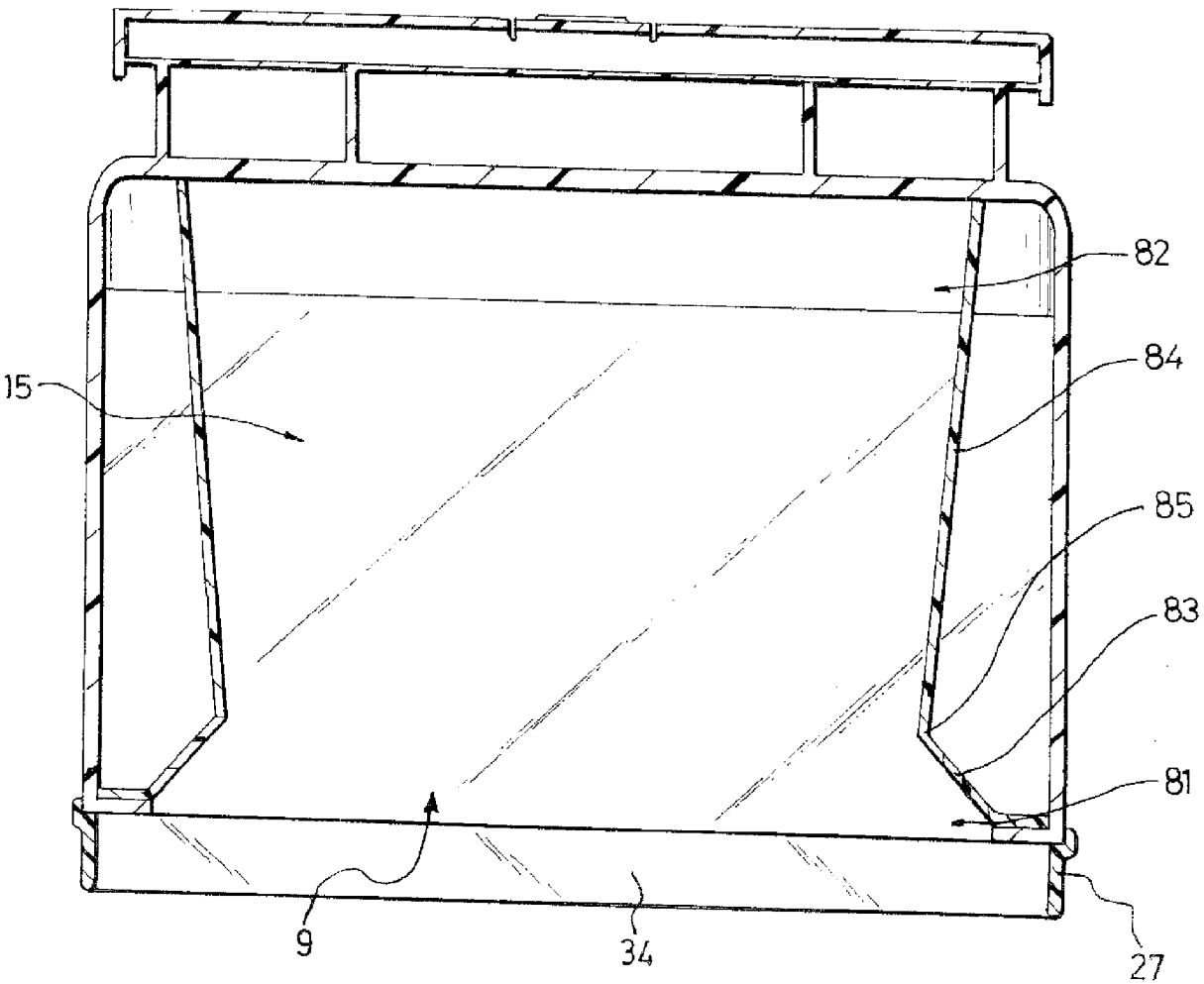
Figure 8:
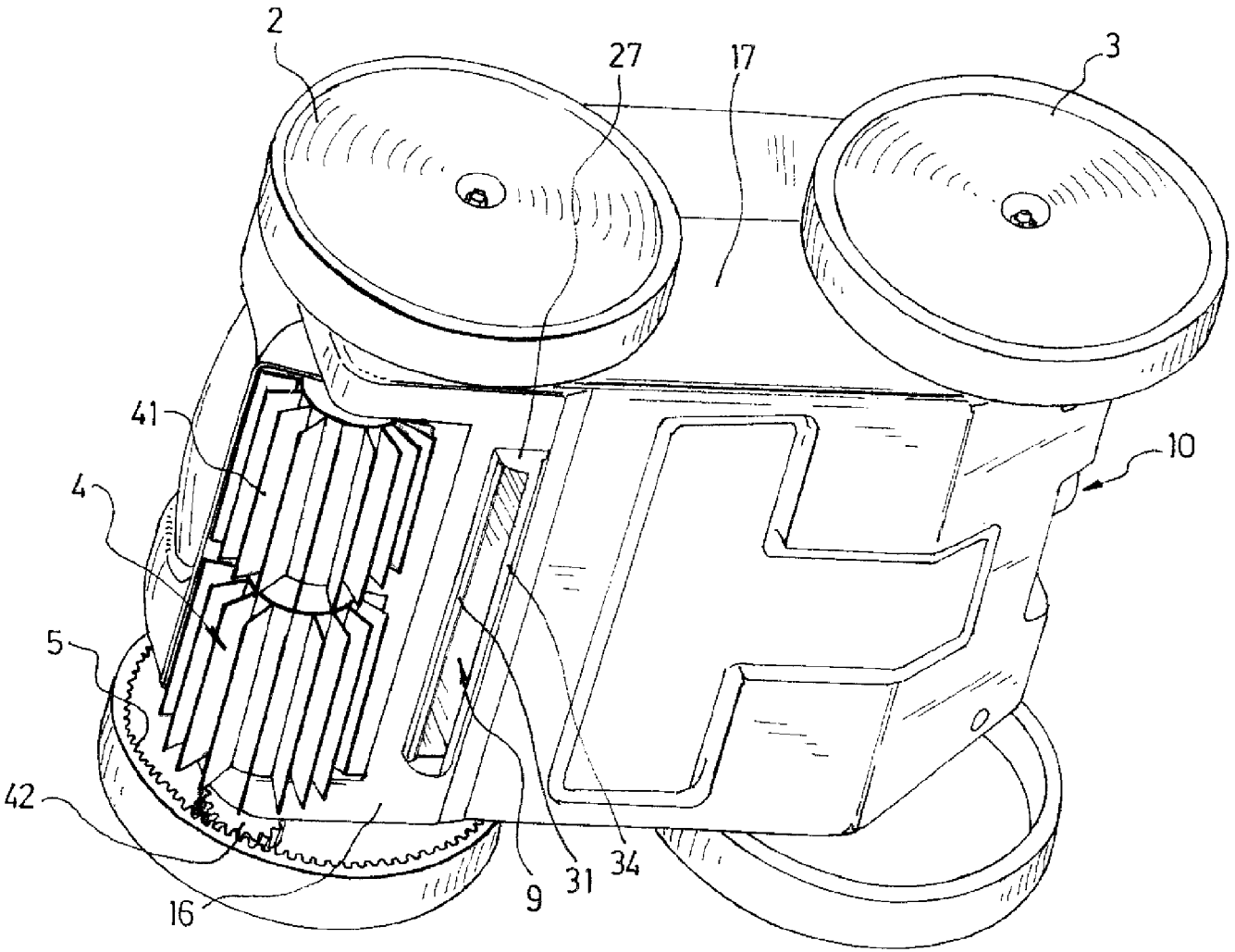
Figure 9A:
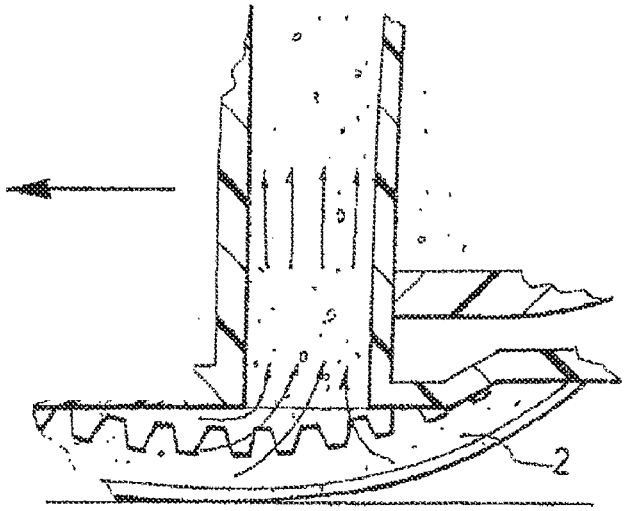
Fig 9a PRIOR ART
Figure 9B:
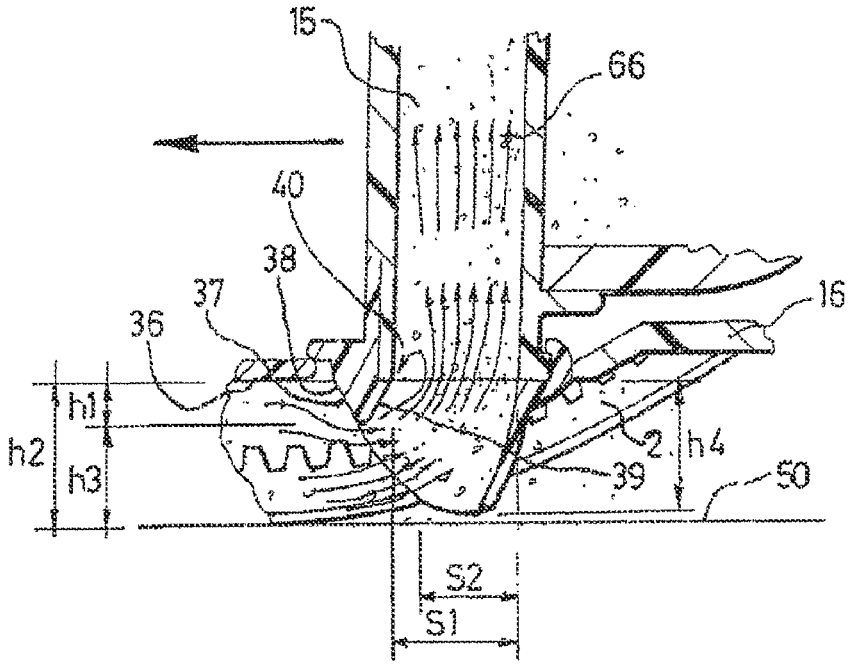

Other features, objects and advantages of the invention will be appreciated from a reading of the following description, given with reference to the appended Figures, in which:

FIG. 1 is a schematic perspective view of a cleaning device according to an embodiment of the invention, FIG. 2 is a schematic longitudinal, vertical sectional view of a cleaning device according to an embodiment of the invention, FIG. 3 is a simplified schematic longitudinal, vertical sectional view of FIG. 2 illustrating the device operating over an immersed surface, FIG. 4 is a schematic perspective view of a filtering device of a device according to an embodiment of the invention comprising two shells which are fitted together, FIG. 5 is a schematic perspective view of the filtering device of FIG. 4 illustrating the two shells separated from each other, FIG. 6 is a schematic longitudinal, vertical sectional view of the filtering device of FIG. 4, the two shells being fitted together, FIG. 7 is a schematic cross-sectional view of the device of FIG. 4 in the region of the inlet conduit of that device, FIG. 8 is a schematic perspective bottom view of the device of FIGS. 1 to 3, FIG. 9*a* is a schematic longitudinal, vertical sectional view illustrating the flow of the liquid in the region of a liquid inlet of a device according to the prior art and FIG. 9*b* is a similar schematic illustration illustrating the flow of the liquid in the region of a liquid inlet of a device according to the invention.

In the Figures, the scales and proportions are not strictly complied with for the purposes of illustration and clarity.

In all of the following detailed description with reference to the Figures, unless indicated otherwise, each component of the cleaning device is described as it is arranged when the device is moving normally over a horizontal immersed surface in a preferred direction of advance, relative to which the front and the rear are defined.

In the embodiment illustrated, a device according to the invention comprises a hollow body 1 and rolling members 2, 3, 4 for guiding and driving the hollow body 1 over an immersed surface in a main direction of advance, called the longitudinal direction, parallel with the immersed surface.

This hollow body 1 is formed principally by a concave housing which delimits a main chamber. This concave housing is, for example, produced by means of molding or rotational molding. This housing is preferably produced from a thermoplastic material, such as polyethylene, polypropylene, ABS, PMMA or any equivalent material.

This hollow body 1 has a central chamber which is capable of receiving a filtration chamber 8. This central chamber is delimited by a lower wall which is called said base 16 and which extends in a substantially horizontal plane; by lateral walls 17 which generally extend in vertical planes; by a front wall 21 which generally extends in a vertical plane, orthogonal relative to the planes of the vertical lateral walls; and by a rear wall 22 which generally extends in a vertical plane orthogonal relative to the planes of the vertical lateral walls.

The base 16 of the body 1 has an opening which extends transversely in the region of the front wall so that liquid is able to enter the central chamber via this lower transverse opening. This opening forms a liquid inlet 9 into the hollow body 1.

The rear wall comprises a cylindrical opening which forms a liquid outlet 10 out of the hollow body 1. This liquid outlet 10 which is provided in the rear wall of the housing is longitudinally offset from the liquid inlet 9 which is provided in the lower wall. Furthermore, this liquid outlet 10 is provided in the upper portion of the housing in such a manner that it is also vertically offset from the liquid inlet 9.

As illustrated in particular in FIG. 2, this central chamber, this liquid inlet 9 and this liquid outlet 10 form a filtration chamber 8. This filtration chamber 8 further comprises a hydraulic circuit which is capable of providing a flow of liquid between the liquid inlet 9 and the liquid outlet 10 through a filtering device 11.

Preferably, the liquid inlet 9 and liquid outlet 10 are centered on the same longitudinal vertical center plane of the device.

The central chamber of the hollow body 1 is capable of receiving a filtering device 11. As illustrated particularly in FIGS. 4 and 5, the filtering device 11 comprises two shells, a first shell 55 which forms a pocket for recovering debris and a second shell 49 which is capable of being fitted to the first shell 55.

The first shell 55 which forms a debris recovery pocket of the filtering device 11 has peripheral filtering walls 56, 57, 58, 59 which extend towards the rear from a front opening 64. These filtering walls 56, 57, 58, 59 are capable of retaining any debris conveyed by the liquid and allowing liquid to flow out of this first shell 55.

The second shell 49 forms a liquid inlet conduit 15 in the hollow body 1. That liquid inlet conduit 15 extends inside the hollow body 1 and has an end, which is called said lower end 81 and which is substantially located in the region of the base 16 of the hollow body 1, and an opposite end which is called said upper end 82 and which opens, when the shells 49 and 55 are assembled, in the first shell 55. That inlet conduit 15 has a regular cross-section whose surface-area varies from the lower end 81 thereof up to a maximum value at the upper end 82 thereof.

To that end, and as illustrated in FIGS. 6 and 7, the inlet conduit 15 has a longitudinal profile which is generally divergent from its lower end 81 as far as its upper end 82, and a transverse profile which has a convergent/divergent shape. The inlet conduit 15 has a first convergent portion 83 from the lower end 81 thereof as far as a zone forming a neck 85 having a minimum surface-area, and a second divergent portion 84 which extends the first portion 83 from that neck 85 as far as the upper end 82 thereof. According to a preferred embodiment of the invention, the first portion 83 extends over less than 20% of the total length of the inlet conduit 15 and the second portion 84 extends over more than 80% of the total length of the conduit 15. The inlet conduit 15 further has, in the region of the upper end 82 thereof, a regular cross-section having a surface-area twice as large as the surface-area of the cross-section in the region of the lower end 81 thereof. The surface-area of the regular cross-section in the region of the neck 85 is in the order of 20% less than the surface-area of the cross-section in the region of the lower end 81.

The assembly between the first shell 55 and the second shell 49 can be produced using various means. For example, and as illustrated in FIG. 5, the first shell 55 comprises, in the region of the front lower end thereof, pins 68 which protrude from the plane of the opening 64 of the first shell 55. These pins 68 have shapes and dimensions which correspond to and complement apertures 69 which are provided in tongues 70 which are fixedly joined to the rear lower end of the inlet conduit 15 and which are substantially perpendicular relative to the rear wall of the conduit so that these pins 68 can engage in the apertures 69 and allow a mechanical connection of the lower ends of the first shell 55 and of the second shell 49. Furthermore, the first shell 55 has, in the region of the front upper end thereof, an element 71 which is capable of engaging in a catch 72 which is provided in the region of the upper end of the front wall of the conduit 15 in order to allow the assembly between the upper ends of the first shell 55 and the second shell 49. This element 71 protrudes relative to the plane of the opening 64 and has a strip which extends downwards and which is not illustrated in the Figures and which is capable of engaging in the catch 72. The end of the catch 72 orientated towards the first shell 55 is further beveled in order to facilitate the insertion of the strip of the element 71 in the catch 72. Furthermore, this strip 72 is flexible in terms of compression so that it can become slightly deformed in a downward direction during the engagement between the element 71 and this catch 72. This flexibility in terms of compression also allows a user to apply a downward pressure to the catch 72, for example, using his thumb, which allows the strip of the element 71 to be disengaged from the catch 72, thus bringing about a separation of the upper ends of the first shell 55 and the conduit 15. The assembly between the first shell 55 and the second shell 49 is produced by first fitting the lower ends to each other then by fitting the upper ends one inside the other. The shells are separated by first disengaging the upper ends from each other, then by disengaging the lower ends from each other. The assembly and the separation of the first shell 55 and the second shell 49 can therefore be readily carried out by a user without any tools.

This relative assembly between the first shell 55 and the second shell 49 is adapted so that, once assembled, the second shell 49 closes said front opening 64 of the first shell 55, with the exception of a liquid inlet passage which constitutes a liquid inlet opening 54 in the first shell 55, the cross-section of this inlet opening 54 being smaller than that of the front opening 64 of the first shell 55.

The first shell 55 which forms the pocket for recovering debris is formed by a rigid frame 26 and a filtering sheet—in particular a filtering material—which extends in openings which are provided by this frame. The filtering device 11 is therefore self-supporting and can be readily handled by a user. Furthermore, this filtering device 11 forms a removable filtering casing whose lower end defined by the lower end of the inlet conduit 15 forms the liquid inlet 9 into the hollow body 1.

Furthermore, the first shell 55 has a regular cross-section which decreases from the front opening 64 towards the liquid outlet 10 in order to form a convergent chamber for tangential type filtering of the liquid flowing between the opening 64 and the liquid outlet 10.

According to the embodiment of the Figures, the first shell 55 has a lower filtering wall 56 which is inclined backwards and upwards from a base portion of the first shell 55. This inclined lower wall 56 forms with the longitudinal direction an angle which, in the example illustrated, is in the order of 45°.

This first shell 55 further comprises a generally horizontal upper wall 57 which extends towards the rear from the front opening 64. This upper filtering wall 57 is connected to the lower filtering wall 56 via an upper rear extreme curved portion 61. The rear extreme curved portion 61 has a minimal regular cross-section whilst the portion of the first shell 55 opposite this curved portion 61, that is to say, in the region of the front opening 64, has a maximum regular cross-section. In this manner, the first shell 55 has a regular cross-section which decreases from the front opening 64 towards the rear extreme curved portion 61, that is to say, towards the rear outlet 10. That is to say, the first shell 55 has a regular cross-section which is in the form of a rectangular triangle, the inclined lower wall 56 forming the hypotenuse.

The device also comprises, as illustrated in FIG. 1, a flap 6 for access to this filtering device 11. This access flap 6 forms an upper wall of the hollow body 1 and covers it. In the embodiment illustrated, this flap 6 is arranged on the upper portion of the device so that a person using the device can readily open the flap 6 and remove the filtering device 11. Preferably, the access flap 6 is articulated to the body 1 of the device by means of hinges 23 which are provided at the rear of the device.

Preferably, the filtering device 11 is a device which is mounted in the filtration chamber 8 of the hollow body 1 in the manner of a drawer. To this end, the rigid frame 26 of the filtering device 11 further has two ribs 25 which extend laterally at each side of the filtering device 11. These ribs are preferably provided on the lateral walls of the inlet conduit 15 since this conduit has no filtering walls. However, according to other embodiments, they could be provided on the lateral walls of the filtering walls, for example, on the frame 26 of the first shell. Regardless of their position, these ribs 25 have shapes and dimensions which correspond to and complement the shapes and dimensions of grooves which are fixedly joined to the hollow body 1. These grooves which are fixedly joined to the hollow body 1 extend vertically along the inner faces of the vertical lateral walls of the hollow body 1. The ribs 25 of the filtering device 11 are therefore capable of co-operating with the grooves of the hollow body 1 of the device.

In this manner, the removal of the filtering device 11 is the result of a translation movement of the filtering device 11 along the grooves of the hollow body 1. A user can therefore readily remove the filtering device 11 from the hollow body 1, for example, in order to clean it. After the filtering device 11 has been removed, a user, as indicated above, can readily separate the two shells which form this device. This user can therefore clean the first shell which forms the debris recovery pocket and the second shell 49 which forms the inlet conduit 15 and the liquid inlet 9 which is arranged at the lower end of the inlet conduit 15. After the first shell 55 and the second shell 49 have been cleaned, the user can readily assemble those shells 49, 55 as indicated above and easily reintroduce the filtering device 11 in one piece into the hollow body 1 by orientating the filtering device 11 so that the ribs 25 of the filtering device 11 are opposite the grooves of the hollow body, then by sliding the filtering device 11 in the hollow body 1.

The filtering device 11 further comprises a handle 28 which is provided on an upper portion of the filtering device 11 in order to facilitate handling of the filtering device 11. In particular, a user is able to readily assemble/disassemble the filtering device 11 using this handle 28 when the device is out of the liquid and rests on a horizontal surface. According to a particularly advantageous embodiment, the handle 28 is the continuation of the rear portion of the element 71.

The lower end 81 of the inlet conduit 15 of the filtering device 11 is located in the region of the base 16 of the hollow body 1, in such a manner that it forms the liquid inlet 9. That liquid inlet 9 is, in the example illustrated, generally rectangular, extending transversely over the majority of the width of the base 16 of the hollow body. That liquid inlet 9 is delimited by a border which extends in a plane which is preferably at least substantially horizontal, that is to say, at least substantially parallel with the immersed surface. The liquid is introduced into the inlet conduit 15 via that liquid inlet 9 in a direction corresponding to that of the inlet conduit 15 in the region of that liquid inlet 9, and that direction is at least substantially vertical, that is to say, at least substantially orthogonal to the immersed surface.

The lower end 81 of the conduit 15 is further provided with an end fitting which forms a flow guide 27 and which is mounted on the lower end 81 by mechanical assembly in accordance with all suitable assembly means (resilient locking engagement; screwing; adhesive bonding; welding, etc.).

The flow guide 27 has, in front of the liquid inlet 9, a front rib 31 which extends along the front edge 32 of the rectangular opening which is formed by the lower end 81. The rib 31 constitutes an acceleration protuberance which protrudes relative to the base 16 of the hollow body 1 towards the immersed surface (that is to say, towards the rolling plane 50 of the device described below) over a given height h1 which is less than the height h2 separating the base 16 from the immersed surface and the rolling plane 50. In this manner, a liquid depth h3 is maintained between the lower extreme portion 33 of the rib 31 and the immersed surface (rolling plane 50). And this depth h3 is greater than the height h1 of projection of the rib 31 relative to the base 16 of the hollow body.

The rib 31 is rigid and has a height h1 which is constant over the entire length thereof, that is to say, the entire length of the front edge of the liquid inlet 9. Preferably, h1 is less than h3 and more preferably less than h3/2. More particularly, h1 is preferably greater than 5 mm and h3 is preferably greater than 7 mm. For example, h1 is in the order of 7 mm and h3 is in the order of 15 mm, h2=h3+h1 being in the order of 22 mm. Naturally, other values are possible, selection thereof resulting from optimization in accordance with the performance levels of the device, the shapes and dimensions and the use thereof.

The lower extreme portion 33 of the rib 31 is a convex edge 33 which forms a discontinuity of curvature which is capable of producing, under the effect of the advance of the device, a turbulent phase downstream of that edge 33. Such discontinuity of curvature has the effect of bringing about detachment of the boundary layer downstream of the edge 33. The radius of curvature of the edge 33 is constructed so as to be as small as possible, taking into account the production constraints (in particular by molding) and constraints during use (in order to prevent any injury to the user during handling). For example, it is less than 1 mm, in particular less than h1/10.

Furthermore, that extreme edge 33 of the acceleration protuberance 31 is in front of the front edge 32 of the liquid inlet 9 in order particularly not to impede, even partially, that liquid inlet 9. In this manner, the whole section S1 of the liquid inlet 9 is maintained (that is to say, remains the same in the absence and in the presence of the acceleration protuberance 31) and allows debris to pass.

Furthermore, in the embodiment illustrated, the rib 31 has, in front of the edge 33, a substantially planar, inclined face 37 which is connected to the front portion 36 of the base 16 of the hollow body 1 located immediately in front of the liquid inlet 9. The inclined face 37 is connected to the front portion 36 of the base 16 by a concave edge 38 which also forms a discontinuity of curvature between said front portion 36 and the inclined face 37.

In the embodiment illustrated by way of example, the rib 31 has a regular cross-section (in section through a longitudinal vertical plane of the device) which is generally in the form of an isosceles triangle whose apex is orientated downwards (formed by the edge 33). The rib 31 therefore also has a rear inclined face 39 which is connected to the front edge 32 of the lower end 81 of the inlet conduit 15. Other shapes of cross-sections may be envisaged (rectangular triangle, plate, etc.).

The flow guide 27 also has, to the rear of the liquid inlet 9, a rear guiding wall 34 which protrudes relative to the base 16 of the hollow body 1 over a height h4 greater than the height h1 of the front rib 31. The height h4 of the rear guiding wall 34 is preferably slightly less than the height h2 separating the base 16 from the rolling plane 50, that is to say that the rear guiding wall 34 extends over most of the depth h2 of liquid passing under the base 16 of the hollow body 1. The rear guiding wall 34 serves to prevent or in any case limit inadvertent leaks of liquid being drawn in from a location behind the liquid inlet 9 and to improve the guiding of the liquid by redirecting it upwards into the inlet conduit 15. It is preferably slightly curved forwards and downwards so as to facilitate the redirection of the liquid.

The rear guiding wall 34 has a lower extreme edge 35 which is advantageously provided with bristles or tongues or other members for scraping or sweeping (not illustrated) the immersed surface.

The extreme lateral walls of the flow guide 27 may be formed in order to bring about a connection between the front rib 31 which forms an acceleration protuberance and the rear guiding wall 34. In a variant, nothing prevents the flow guide 27 from not being provided with lateral walls.

It should be noted that, in any case, the end border formed by the flow guide 27 forming the leading edge thereof relative to the hydraulic flow does not extend in a plane. The end 33 of the front rib 31 which forms a protruding acceleration protuberance constitutes a portion of that leading edge and has, relative to the immersed surface, a height different from the remainder of the other border portions of that leading edge.

In the example illustrated, the device comprises a motorized liquid pumping device which comprises an electric pumping motor 12 which has a rotating drive shaft 13 which is coupled to a pumping propeller 14 which is interposed in the hydraulic circuit in order to generate therein a liquid flow between the liquid inlet 9 and the liquid outlet 10. The liquid outlet 10 is directly opposite the pumping propeller so that the liquid flows out of the liquid outlet 10 in a direction which corresponds to the liquid flow generated by the pumping propeller, this flow having a speed which is orientated in accordance with the rotation axis 51 of the propeller 14.

The pumping propeller 14 has an orientation which allows a flow of liquid to be generated with a horizontal component towards the rear.

Preferably, the pumping propeller 14 which is interposed in the hydraulic circuit between the liquid inlet 9 and liquid outlet 10 has an inclined rotation axis which forms, with said longitudinal direction and with the theoretical rolling plane 50, an angle $\alpha$ which is not equal to 90°. This propeller 14 is rotated by means of the electric pumping motor 12 which preferably has a rotating drive shaft 13 which is parallel with the rotation axis of the propeller 14.

According to the invention, the electric pumping motor 12 is arranged below the hydraulic circuit entirely at the outer side of this hydraulic circuit which completely bypasses the pumping motor 12 at the top. The rotating shaft 13 of the pumping motor 12 extends through a lower inclined wall 30 which delimits the hydraulic circuit. The sealing is provided by an O-ring 18.

FIGS. 3 and 9*b* are illustrations of the flow of liquid at the inlet of the device according to the invention and in the hollow body 1 of the device. This flow is illustrated schematically by means of the arrows 66.

As can be seen, the liquid flow drawn in from the front of the device during its movement is redirected by the rib 31 which has the effect of generating, under the effect of the advance of the device, a zone 40 having a turbulent phase downstream of the rib 31, and of drawing in the effective hydraulic cross-section of the flow being introduced into the liquid inlet 9 but without obstructing or restricting the total effective cross-section of flow S1 of the liquid inlet 9. In other words, the effective hydraulic cross-section S2 of the liquid flow into the liquid inlet 9 is less than the total effective cross-section of flow S1 of the liquid inlet 9, which allows large debris to pass. As a result, in the region of the liquid inlet 9, the liquid is accelerated and its dynamic pressure is increased. The redirection of the liquid in the liquid inlet 9 is further promoted by the rear guiding wall 34. For the same overall depth h3 of flow of the liquid under the device, on the one hand the speed and the dynamic pressure of the liquid flow being introduced into the device are increased and, on the other hand, the floor clearance h2 of the base 16 of the hollow body is increased.

Digital simulations corroborated by tests have shown that, in the absence of the fitting forming the flow guide 27 at the end 81 of the conduit 15, and therefore in the absence of any acceleration protuberance, as illustrated in FIG. 9*a*, with a device according to the prior art, it is possible to obtain, for a front floor clearance h2 of 15 mm, dynamic pressure of 125 Pa and a mean speed of 0.64 m/s at the liquid inlet 9. In the configuration according to the invention illustrated in FIG. 9*b*, with a rib 31 having a height h1 of 7 mm, a front floor clearance of the base h2 of 22 mm and a depth h3 of flow of liquid of 15 mm, there is obtained a dynamic pressure of 320 Pa (that is, an increase of 156%) and a mean speed of 0.80 m/s (that is, an increase of 25%) at the liquid inlet 9. Tests carried out have also shown that large pieces of debris are drawn in by a device according to the invention comprising an acceleration protuberance 31 in accordance with the embodiment illustrated in the Figures, whilst those pieces of debris are not drawn in by a device which is similar but not provided with that acceleration protuberance.

It should further be noted that a device not in accordance with the invention which has a lower base 16 of the hollow body not provided with an acceleration protuberance and having a height h3 of the rolling plane equivalent to that of the acceleration protuberance of a device according to the invention has a much lower intake capacity. In this manner, for the same overall floor clearance (h3), the intake performance levels of a device according to the invention are distinctly better.

Furthermore, the floor clearance of the device according to the invention in the region of the acceleration protuberance 31 is localized in a point-like manner, which limits and even reduces the risks of becoming blocked on obstacles at the bottom of the pool. That is particularly the case when the acceleration protuberance 31 is close to a transverse plane containing an axle (in particular as in the embodiment illustrated, in which the protuberance 31 is near the transverse plane containing the contact zones of the front wheels 2 with the immersed surface).

Liquid enters the hollow body 1 via the liquid inlet 9 which is arranged below the device. This liquid passes into the second shell 49 which forms the liquid inlet conduit 15 in order to reach the first shell 55 which forms a debris recovery pocket. This debris recovery pocket allows the liquid to pass through the filtering material and retains the solid debris 60. The filtered liquid reaches the liquid outlet 10 and is discharged at the rear of the device into the pool from which it originates.

Since the liquid outlet 10 is opposite the pumping propeller 14, the liquid flows out of the device via this outlet with a speed V which is orientated along the axis 51 of the pumping propeller 14 and which has a longitudinal component towards the rear which brings about, by means of reaction, forces whose resultant has a longitudinal drive component which is orientated towards the front and which is involved in driving the device over the immersed surface.

The orientation of the hydraulic reaction force produced by the outlet flow and therefore the size of the longitudinal component thereof are dependent on the inclination $\alpha$ relative to the theoretical rolling plane 50, the rotation axis 51 of the propeller and the liquid outlet 10. Preferably, this inclination a is between 15° and 45°.

The electric pumping motor is arranged below the hydraulic circuit entirely at the outer side of this hydraulic circuit so that the filtering device 11 of the hydraulic circuit can be removed from the device via the top of the device as mentioned above, without being impeded by the pumping motor. Only the pumping propeller 14 is arranged in the hydraulic circuit so as to be able to provide the liquid flow. This pumping propeller 14 is arranged at the rear of the device, close to the liquid outlet 10. That is to say, the pumping propeller 14 and the liquid outlet 10 form the end portion of the hydraulic circuit.

In the embodiment of the invention illustrated in the Figures, the rolling members for guiding and driving the device comprise a front axle which comprises front drive wheels 2, one at each side, and a rear axle which comprises rear non-drive wheels 3, one at each side.

Furthermore, as illustrated in the Figures, the device comprises brushes 4 which are arranged at the front of the device. These brushes 4 are intended to brush the immersed surface and move the debris which are brushed to the rear of the device in the direction of the liquid inlet 9 which is arranged below the device.

The device further comprises at least one electric motor 20 for driving the front drive wheels 2. Preferably, the device comprises two drive motors, one at each side, for independently driving each of the front wheels 2, respectively. To this end, each front wheel 2 has an internally toothed arrangement 5 which co-operates with a pinion which is driven by the corresponding drive motor 20.

These brushes 4 may be of any type. According to an embodiment of the invention, the device comprises two front coaxial brushes 4. Each brush 4 is capable of being rotated about an axis which extends in a direction perpendicular relative to the longitudinal direction. Each brush 4 comprises a plurality of fins 41 which extend radially from a brush shaft which forms the rotation axis of the brush 4. The fins 41 are, for example, of rubber or a strong plastics material.

Furthermore, the brushes 4 are preferably also rotated by at least one electric motor 20 for driving the front wheels 2 by means of a gear system.

In this manner, in the embodiment illustrated, the rolling members are constituted by the front drive wheels 2, rear non-drive wheels 3 and brushes 4 which are involved in driving and guiding the device over the immersed surface. In any case, the rolling members 2, 3, 4 have zones which are intended to come into contact with the immersed surface and which are coplanar and define a theoretical rolling plane 50. The longitudinal direction of advance of the device is parallel with this theoretical rolling plane 50.

The front wheels 2 preferably have a diameter of between 100 mm and 500 mm, in particular between 150 mm and 250 mm. According to the embodiment of the Figures, the front wheels 2 have a diameter in the order of 200 mm. In this manner, the front wheels 2 make it easier to overcome obstacles and have improved traction. Advantageously, their peripheral tread is formed by or covered with an anti-skid material.

The front wheels 2 and the brushes 4 constitute front drive rolling members 2, 4 which protrude forwards relative to the other constituent elements of the device, in particular the hollow body, in order to form the extreme front portion of the device and first come into contact with an obstacle which is encountered during the forward movement.

The electric drive motor and the electric pumping motor may be of any known type. According to a preferred embodiment, these electric motors are low-voltage motors. They can be supplied with electrical power via an electrical power supply external to the device via an electrical cable which is not illustrated in the Figures and which is connected to the device in the region of a zone 19 for introducing the electrical cable into the device, as illustrated in FIG. 1.

Furthermore, the device illustrated also comprises an operating handle 7 which allows a user to carry the device in order to immerse it in a liquid and remove it therefrom. This handle 7 is preferably arranged opposite the liquid outlet 10 so that, when the hollow body 1 is suspended via this handle, the device tilts spontaneously under the effect of gravity into a position in which the liquid outlet 10 is located below the liquid inlet 9 which allows the device to be emptied. When the device moves from the cleaning position to the emptying position, the debris drawn in by the device are retained in the filtering device and cannot be discharged from the device.

Of course, the invention may involve numerous construction variants and applications.

For example, according to an embodiment which is not illustrated in the Figures, the filtering device 11 comprises a plurality of convergent/divergent liquid inlet conduits 15.

Furthermore, the sizing and the configuration of the device, in particular the hydraulic circuit thereof, are subject to an infinite number of variants. In addition, the invention can be used for a bi-directional device which is capable of backward movement.

More generally, the invention applies to any other category of motorized or non-motorized devices. There may be provided a plurality of liquid inlets and, for each liquid inlet, one or more acceleration protuberance(s). Each acceleration protuberance may be formed by a plurality of elements interposed in the flow (upstream of the corresponding liquid inlet forming an edge thereof or remotely from an edge thereof) with a given height, for example, arranged in staggered rows or another arrangement, with the effect of producing a turbulent phase and, above all, increasing the speed of the liquid and its dynamic pressure at the inlet of the hollow body of the device.

When the shape of the liquid inlet is not rectangular but instead, for example, is oval, the projecting height of each acceleration protuberance may not be constant along the upstream edge of the liquid inlet. For example, the height h1 of each acceleration protuberance at each location may depend on the width of the liquid inlet downstream of that location. More generally, that height h1 is optimized in accordance with the dimensions and performance levels of the device, in particular in accordance with the size of the liquid inlet, the intake flow of the pump (pumping propeller 14 and associated motor). Naturally, increasing the height h1 of each acceleration protuberance improves the effects produced by that acceleration protuberance as indicated above, but increases the loss of load brought about and reduces the cross-section of flow under the device.

Furthermore, the base 16 of the hollow body 1 and more particularly the front portion 36 thereof is not necessarily planar, as illustrated, but may be profiled with a suitable curvature, for example, concave, so as to facilitate the flow path upstream of the acceleration protuberance 31. The acceleration protuberance may be formed by the base 16 and not by the lower end 81 of the filtering device 11. The same applies to the rear guiding wall.

The invention claimed is:

1. A swimming pool cleaner comprising:

a. a body comprising an outlet and a base defining an inlet having a cross-section, the base located a first distance above a surface to be cleaned when the body is upright;

b. a pumping device configured to cause water to flow from the inlet to the outlet;

c. means for moving the body in a forward direction; and d. a protuberance (i) protruding downwardly a second distance from the base when the body is upright, the second distance being less than half of the first distance, and (ii) configured (A) so as not to reduce the cross-section of the inlet and (B) to create a zone of turbulence at least when the body is moving in the forward direction.

2. A swimming pool cleaner according to claim 1 in which the protuberance comprises a rigid rib.

3. A swimming pool cleaner according to claim 2 in which the rigid rib has generally triangular cross-section.

4. A swimming pool cleaner according to claim 2 in which the inlet has a peripheral edge portion to the front thereof when the body is moving in the forward direction and the rigid rib extends at least substantially parallel to the front peripheral edge portion.

5. A swimming pool cleaner according to claim 2 in which the inlet has a peripheral edge portion to the front thereof when the body is moving in the forward direction and the rigid rib forms the front peripheral edge portion.

6. A swimming pool cleaner according to claim 1 further comprising a filtering device positioned between the inlet and the outlet so as to filter water flowing therethrough.

* * * * *